United States Patent [19]

Hart

[11] 4,347,270

[45] Aug. 31, 1982

[54] DECORATIVE ARTICLE

[76] Inventor: Frederick E. Hart, 3019 K St. N.W., Washington, D.C. 20007

[21] Appl. No.: 182,593

[22] Filed: Aug. 29, 1980

Related U.S. Application Data

[63] Continuation of Ser. No. 757,336, Jan. 6, 1977, abandoned.

[51] Int. Cl.[3] ..... B44C 5/04

[52] U.S. Cl. ..... 428/13; 264/132; 264/246; 428/67

[58] Field of Search ..... 156/293, 298, 303.1; 264/132, 135, 246; 428/13, 31, 45, 46, 67, 327

[56] References Cited

U.S. PATENT DOCUMENTS

| | | | |
|---|---|---|---|
| 748,284 | 12/1903 | Karwowski | 428/13 X |
| 2,440,205 | 4/1948 | McLain | 428/13 X |
| 2,451,913 | 10/1948 | Brice | 428/67 |
| 2,453,052 | 11/1948 | Van Etten | 428/248 |
| 2,511,552 | 6/1950 | Stuempges | 428/13 |
| 2,577,320 | 12/1951 | Fenyo | 428/13 X |
| 2,636,301 | 4/1953 | Wilmsen | 428/13 |
| 2,731,672 | 1/1956 | Davis et al. | 428/13 X |
| 3,312,197 | 4/1967 | Smith | 428/13 X |
| 3,440,129 | 4/1969 | Anselm | 428/31 X |
| 3,886,248 | 5/1975 | Nicholson | 428/13 X |

*Primary Examiner*—Henry F. Epstein
*Attorney, Agent, or Firm*—John P. Snyder

[57] ABSTRACT

A decorative article, and method, wherein a shaped mass of transparent material is embodied within a block of the same material so as to provide a shaped interface. Selected regions or areas of the interface are conditioned with light reflective material so as to render visible selected portions of the otherwise invisible interface, thereby achieving a three dimensional display having a shape controlled by the shaping of the interface but whose quality or artistic content is controlled by the conditioning of the interface.

6 Claims, 5 Drawing Figures

DECORATIVE ARTICLE

This is a continuation of Ser. No. 757,336 filed Jan. 6, 1977 and now abandoned.

BACKGROUND OF THE INVENTION

This invention relates to decorative articles of the type wherein a decorative three-dimensional design is embodied within a body of transparent material.

There are many examples of embedded objects within a transparent block or body wherein the decorative aspect stems from the embedded object itself. The object may be a simple design of essentially two-dimensional characteristics or it may be a fully three-dimensional design. Natural objects are examples of the latter type and, in many instances, natural objects may be simulated by forming a mold cavity in a transparent body and filling it so as to simulate a natural object. The Davis et al U.S. Pat. No. 2,731,672, the Wilmsen U.S. Pat. No. 2,636,301 and the Stuempges U.S. Pat. No. 2,511,552 illustrates these prior art techniques.

However, these prior art devices tend to be dominated by the massive or bulky nature of the embedded object, whether natural, simulated or otherwise and therefore tend to impart a solid and harsh visual aspect.

BRIEF SUMMARY OF THE INVENTION

The present invention is basically directed to a method and article formed thereby in which a shaped interface, otherwise invisible, is formed interiorally within a body of transparent material, the shaped interface being rendered visible in selected regions thereof so as to be visually identifiable without imparting a heavy, massive appearance thereto.

BRIEF DESCRIPTION OF THE DRAWING FIGURES

DETAILED DESCRIPTION OF THE INVENTION

Figure 1:
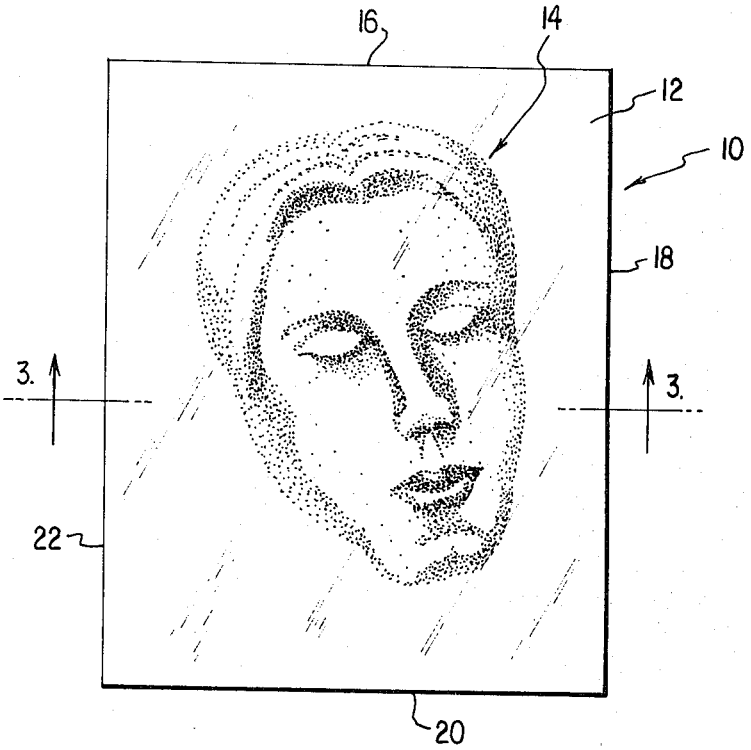
FIG. 1 is a plan view of a decorative article constructed according to this invention.

Referring at this time to FIG. 1, the invention as embodied therein comprises a block of transparent material indicated generally by the reference character 10 and presenting a principal viewing face 12 through which the decorative image 14 may be viewed, as shown. In the particular embodiment of the invention illustrated in the drawings, the block 10 is of rectangular form so as to present, in addition to the principal viewing surface 12, the side viewing surfaces 16, 18, 20 and 22, as will be evident from FIGS. 1, 2 and 3.

Figure 3:
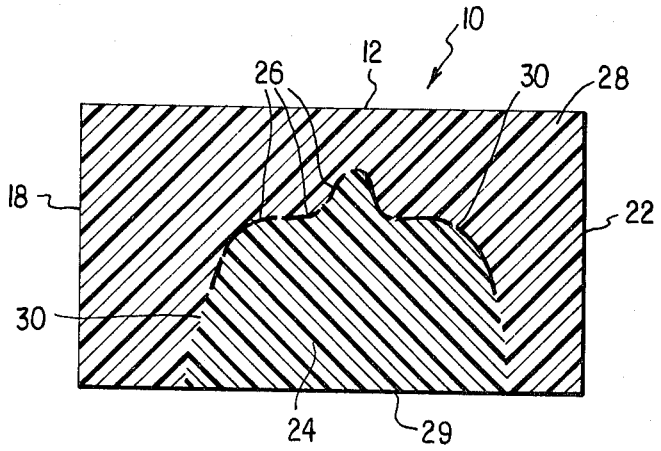
FIG. 3 is a transverse sectional view taken substantially along the plane of section line III—III in FIG. 1.

The decorative article is made by first molding or otherwise forming a body of the transparent material to the shape of the object to be displayed, this shaped body being indicated by the reference character 24 in FIG. 3 and distinguished therein by the shading lines as distinct from the body of material 28 which defines the aforesaid viewing surfaces.

The body 24 is thereafter embedded within the body 28 to form therewith a solid block of material. Preferably, the body portion 28 is poured in liquid form into a mold within which the body portion 24 has been placed. The body portions 24 and 28, in any event, define an interface between them which follows the contours of the shaped body 24. To the extent that the materials of which the two portions 24 and 28 are identical or have the same index of refraction, this interface will be invisible when viewed through the various surfaces 12, 14, 16, 18, 20 and 22 or through the bottom surface 29 of the body 24.

However, if any portion of the surface of the shaped body 24 is conditioned to alter its index of refraction, its light-absorbing or light-reflecting properties prior to being joined with the body 28, the interface at such portion will be visible to a viewer. By so conditioning selected portions of the shaped surface of the body 24, extremely interesting and creative effects can be produced. The artistry of these effects is dependent upon the skill and imagination of the artist creating them and the technique employed to condition the shaped surface, the variations in effect being limitless.

Many techniques may be employed to condition the shaped interface. For example, paint or other pigmented or light reflective or absorbing liquid medium may be applied to selected portions of the shaped surface to render enough of the subsequent interface sufficiently visible as to render the overall shape and/or any desired details of the interface identifiable to the viewer. The medium may be applied non-uniformly to the selected regions to heighten the phantomness of the interface. Many other techniques will suggest themselves to the skilled artisan as, for example, the application of spaced stripes on the shaped surface, roughening of selected portions of the shaped surface followed by the application of pigmentation or the like onto the shaped surface followed by wiping off the excess whereby those areas most deeply roughened will accumulate the greatest depth of pigmentation, etc.

In any event, the basic concept involves a conditioning of the interface-forming surface such that the interface becomes visually identifiable at least to that extent required to identify the nature and extent of the shaped body portion 24, and to create the desired quality of the image.

Figure 2:
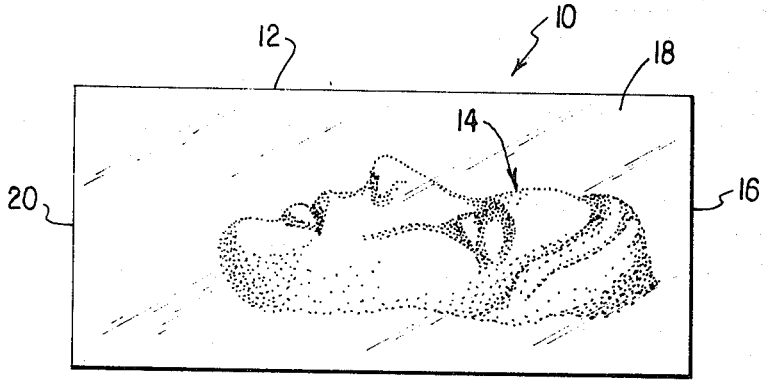
FIG. 2 is a side elevational view of the article shown in FIG. 1.

To illustrate one embodiment of the invention which possesses the ethereal quality illustrated in FIGS. 1 and 2, after the shaped body 24 is formed, light-reflecting material such as paint or other film-forming material is sprayed or otherwise applied selectively to the shaped surface of this body 24 as, for example, in the regions designated by the reference character 26 in FIG. 3. This light-reflecting material is applied lightly or heavily as may be desired but it is applied in selected regions of the surface of the shaped body 24 so as to leave other surfaces or regions thereof free or substantially free from such film-forming material thus limiting the visibility of the interface to less than its entirety.

Thereafter, the body 24 with the light-reflecting material applied thereto is placed in a suitable mold wherein the material forming the body 28 is molded therearound so that the shaped body 24 is suitably embedded within the body 28. The materials of the body 24 and of the body 28 are preferably identical and in any event have the same or substantially the same index of refraction and coloring (i.e. colorless) so that the interface formed between the two bodies 24 and 28 is rendered visible only in those portions or regions at which the light-reflective material is applied. Thus, the two bodies 24 and 28 are characterized by being joined at an interface therebetween in which such interface includes regions such as that indicated by the reference character 30 which are totally or substantially invisible and limit the visibility of the interface to less than its entirety and other regions such as those indicated by the reference character 26 which are more or less visible depending upon the degree of application of the film-forming material. The result is to allow a very soft and subdued definition of the shaped surface of the body 24 ranging from transparent or extremely translucent to opaque regions and allowing for the maximum of artistic effect to be produced, dependent upon the skill and imagination of the person applying the film-forming material. Results, for example not dissimilar to a three-dimensional etching embodied within the interior of the block may be produced. The material from which the portions 24 and 28 are formed may preferably be very clear plastic or synthetic resinous materials such as the acrylic resins.

Figure 4:
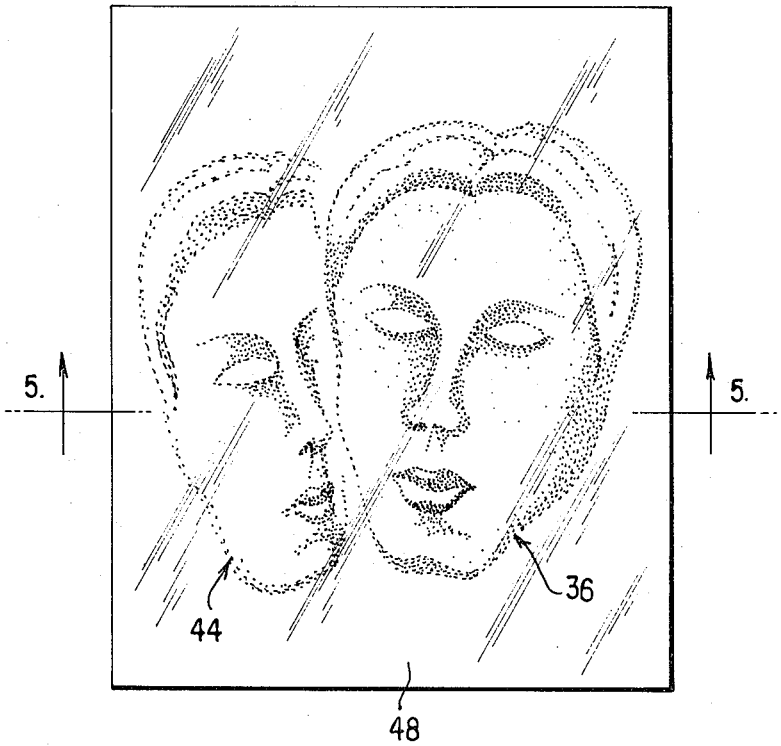
FIG. 4 is a view similar to FIG. 1 but illustrating a modified form of embedded interface.
Figure 5:
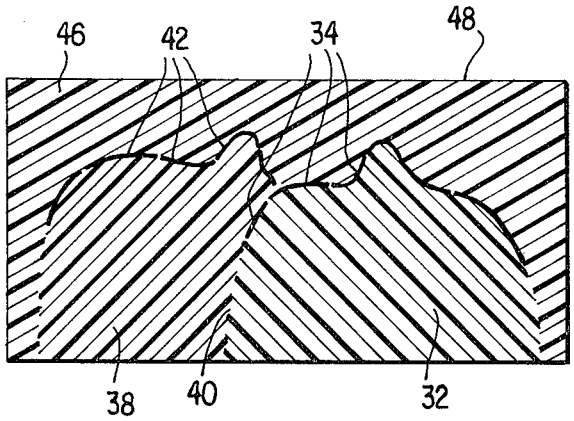
FIG. 5 is a sectional view taken along the section line 5—5 in FIG. 4.

By using two or more shaped bodies, additional decorative or artistic effects can be achieved. Thus, in FIGS. 4 and 5, a first shaped body 32 is formed and selected regions 34 thereof are conditioned ultimately to bring out its image 36. Next, a second shaped body 38 is molded onto the body 32 partially to form the interface 40 therewith. The surface of the body 38 is then conditioned in selected regions 42 ultimately to bring out its image 44. Lastly, the block-forming body 46 is molded to embed both of the bodies 32 and 38, as shown. Thus, three interface regions are formed, one between each of the bodies 32 and 38 and the body 46 and the third between the bodies 32 and 38. Various effects may be created by this technique, chief among which is the merging of images created by the conditioned regions 34 lying at the interface 40 between these two bodies, when viewed through the viewing surface 48.

What is claimed is:

1. A decorative article comprising in combination a substantially homogeneous mass of transparent material presenting at least one viewing surface, and comprising a first portion which provides said viewing surface and a second portion integrally joined with said first portion but lying beneath said viewing surface, said second portion presenting a shaped, transparent and normally indiscernible interface with said first portion; and means non-uniformly disposed over said shaped interface for providing regions of said interface which remain transparent, indiscernible and limit the visibility of the interface to less than its entirety, and other regions of the interface which are visible when viewed through said viewing surface.

2. The decorative article as defined in claim 1 wherein both said first and second portions are colorless, and said first and second portions have the same index of refraction whereby said interface is invisible in the absence of said means.

3. The decorative article as defined in claim 1 wherein said means comprises film-forming material, such as paint, applied to said one component.

4. The decorative article as defined in claim 1 wherein said first and second portions are defined by individual first and second components, said mass further comprises a third component, said second and third components being imbedded within said first component, said third component having a third portion integrally joined with said first portion by lying beneath said viewing surface, said third portion presenting another shaped, transparent and normally indiscernable interface with said first portion, and means non-uniformly disposed over said another shaped interface for providing regions of said another interface which remain transparent, indiscernible and limit the visibility of another interface to less than its entirety and other regions of the another interface which are visible when viewed through said viewing surface.

5. The decorative article as defined in claim 4 wherein said first, second and third portions are colorless, and said first, second and third portions have the same index of refraction whereby said first-mentioned and another interface are invisible in the absence of said first-mentioned and last-mentioned means.

6. The decorative article as defined in claim 4 wherein said first-mentioned and last-mentioned means comprise film-forming material such as paint, applied to said second and third components.

* * * * *